US007179015B1

(12) United States Patent
Rittenhouse et al.

(10) Patent No.: US 7,179,015 B1
(45) Date of Patent: Feb. 20, 2007

(54) REMOTE CONTROLLED TIRE DEFLATOR

(76) Inventors: James Rittenhouse, 25 Lower Center St., Clinton, NJ (US) 08809; Rudor M. Teich, 10 Ridge Rd., West Orange, NJ (US) 07052

( * ) Notice: Subject to any disclaimer, the term of this patent is extended or adjusted under 35 U.S.C. 154(b) by 0 days.

(21) Appl. No.: 11/279,339

(22) Filed: Apr. 11, 2006

Related U.S. Application Data

(60) Provisional application No. 60/773,328, filed on Feb. 15, 2006.

(51) Int. Cl.
*E01F 13/12* (2006.01)

(52) U.S. Cl. ..... 404/6

(58) Field of Classification Search ..... 404/6
See application file for complete search history.

(56) References Cited

U.S. PATENT DOCUMENTS 5,322,385 A * 6/1994 Reisman ..... 404/6
5,498,102 A * 3/1996 Bissell ..... 404/6
5,507,588 A * 4/1996 Marts et al. ..... 404/6
5,588,774 A * 12/1996 Behan ..... 404/6
6,155,745 A * 12/2000 Groen et al. ..... 404/6
6,224,291 B1 * 5/2002 Mateychuk ..... 404/6
6,474,903 B1 * 11/2002 Marts et al. ..... 404/6
7,001,099 B2 * 2/2006 Rittenhouse et al. ..... 404/6
7,025,526 B2 * 4/2006 Blair ..... 404/6

* cited by examiner

*Primary Examiner*—Gary S Hartmann
(74) *Attorney, Agent, or Firm*—Gottlieb Rackman & Reisman

(57) ABSTRACT

A vehicle access control device having vertically-disposed tire-piercing spears. An upwardly spring-biased tent-like covering over the spears protects pedestrians, the covering being movable between a lower position in which the spears are exposed and an upper position in which the spears are covered. The weight of a pedestrian is insufficient to force the covering from the upper position to the lower position but the weight of a car is sufficient to do so. A remotely-controlled horizontally-movable plate selectively enables and disables the tent-like covering to lower under the weight of a car. The plate and the covering both have windows to allow the spears to pass therethrough when the covering is lowered, the plate blocking the windows in the covering when the lowering of the covering is disabled. The device is surface-mountable on a roadway without the need for digging into the roadway.

30 Claims, 9 Drawing Sheets

REMOTE CONTROLLED TIRE DEFLATOR

This application claims the benefits of Provisional Patent Application Ser. No. 60/773,328 filed on Feb. 15, 2006.

FIELD OF THE INVENTION

The present invention is related to devices that control vehicular access through a fixed-width roadway. More particularly, the invention addresses devices that control access by damaging one or more of the tires of an unauthorized vehicle attempting to drive past a control point.

DESCRIPTION OF THE PRIOR ART

Car tire deflators are known in the art. A tire deflator typically has sharp tines designed to puncture one of the car's tires if the car is driven over the deflator. There are two basic types of deflators—fixed and controllable.

Fixed deflators are used to control the flow of traffic and to limit its direction. Fixed deflators may be bi-directional or unidirectional. A bi-directional fixed deflator prevents traffic past the device in either direction, in effect closing a roadway to vehicular traffic. A unidirectional deflator allows traffic in one direction, but blocks it in the opposite direction.

A typical application for fixed unidirectional deflators is for mounting in entrance lanes of a parking area. The deflator discourages vehicles from exiting through an unguarded entrance and directs them to a manned exit lane. A typical fixed uni-directional deflator is described in U.S. Pat. No. 3,783,558 in the name of Keator. The deflator relies on the geometry of the tines to pose a threat in one direction and to act benignly in the other direction. There is no active mechanism involved that activates and deactivates the functioning of the tines.

Controllable deflators differ from fixed deflators in that their tire-puncturing action can be enabled or disabled. This distinguishing feature makes controllable deflators suitable for controlling vehicular access past a control point. To the extent that such devices control vehicular access on a roadway, they can be used interchangeably, or in conjunction with, gates or barriers. Controllable deflators differ in the method by which the tines are rendered inoperative ("safe") or operative ("enabled").

U.S. Pat. No. 4,101,235 in the name of Nelson discloses a controllable deflator used for allowing authorized drivers to have access to a parking lot. The tines swivel on a shaft perpendicular to the flow of traffic. When the device is enabled, the tines are erect and facing the traffic. Any attempt to drive over them will result in the tines embedding themselves into the rubber of the tires. When the device is set to the safe mode, the tines are essentially prone and pose no threat to the tires passing over them. The change between the enabled and the safe states is achieved through an electric motor that rotates the shaft on which the tines are mounted. The mechanism is large, needs to be installed next to the traffic lane, and requires electrical power to operate. This in turn requires trenching and bringing external power to the unit.

U.S. Pat. No. 5,890,832 in the name of Soleau discloses a controllable deflator in which the spears swivel individually on an axis perpendicular to the length of the device. A common slider cam pushes the spears up when it is desired to enable the deflator. This system offers a lower profile, and can be installed on the surface of the roadway. However, it requires substantial power to raise the spears, which dictates trenching and the cost of bringing in external power to the device. It also requires a heavy structure to support and activate the spears, because the moving parts must withstand the heavy forces of vehicles.

A common concern when installing devices with sharp tines, spikes or spears is the danger that they may pose to pedestrians. In some localities, notably Japan, the use of controllable deflators is discouraged due to concerns about pedestrian safety. Patent publication WO 02/081824 A1 in the name of Pendlebury discloses a method for protecting pedestrians from being hurt by a gate that includes barbs designed to capture and retain a car that forces its way through a barrier. A perforated plate is permanently placed in front of the barbs, to prevent pedestrians from contacting the barbs. When a car speeds into the barrier with the intent to ram its way through the roadblock, the guard plate yields and allows the barbs to lodge into the car and hold the car captive.

The Pendlebury device is intended as a one-time-use arresting barrier, and requires a significant kinetic energy from a speeding car to activate the barbs. Another limitation of the Pendlebury device is that in order to remove the road block, the entire assembly of the barbs and the guard plate must be swiveled out of the way of the traffic. This requires a complex and heavy structure and does not lend itself to a commercially viable application as a deflator.

U.S. Pat. No. 6,045,293 in the name of Dickenson discloses a uni-directional controllable deflator system with a pedestrian-friendly feature. The individual tines are covered by a protective member in the form of a sleeve or a cap. Under the pressure of a tire, the protective cover is forced down (in the case of the sleeve) or crushed (in the case of the cap), allowing the tire to come into contact with the tines. The tines with their covers are mounted to a shaft that rotates the entire assembly to a safe position when passage is to be allowed.

One of the limitations of the Dickenson system is that each tine must have its own protective guard, and the guard has to be able to resist the forces of an individual stepping on it. Due to practical size considerations, it is very difficult to generate such resistive forces in a small space. It is likely, therefore, that the protective cover must be of the self-destruct type, relying on the hardness of the cap to be punctured by the tire. That results in a single-use part, with the attendant drawback of a service call requirement after each attempted breach.

Another drawback of the Dickenson system is that the entire assembly must be rotated to disable the deflator. This dictates a heavy shaft, large mass and size, and the requirement for an external power source to operate the motor that rotates the shaft.

When a deflator is used as an access control, it is essential that an approaching driver be aware of the state of the deflator, i.e., whether it is safe to drive through the associated gate or whether the deflator is enabled. One of the common methods to convey this information to the driver is to combine the deflator with an associated barrier or gate. Combination deflators and gates are known in the art. U.S. Pat. No. 4,318,079, also in the name of Dickenson, teaches a combination horizontal gate and deflator, where the two elements move in unison so that the deflator is armed when the gate is raised to block traffic. The shortcomings of Dickenson's system are that it requires outside power to operate a motor, and that the tines are exposed whenever the gate is raised. The sharp tines of the deflator pose a threat to pedestrians, and a malfunction in the complex mechanical linkages between the deflator and the motor can cause the deflator to stay raised even as the gate is lowered, causing damage to authorized cars passing over the device. Another limitation of the Dickenson system is that, once a car forces its way through the gate, the gate will break and will have to be replaced. In addition to the cost or replacing the gate, there may be a long down-time until the gate is repaired.

Thus it is an object of our invention to provide a vehicular access control system that can be installed on the surface of a roadway without trenching or digging, which can be powered by small batteries to eliminate the need to run power to the unit, and which includes a deflator that is pedestrian-safe at all times.

An additional object of our invention is to make the deflator compatible and useable with a self-powered barrier, so that the entire gate system (which comprises the barrier and the deflator) can be self contained and easily installed without external power, digging or wiring.

SUMMARY OF THE INVENTION

The present invention is a controllable tire deflator for use as vehicular access control apparatus. The apparatus switches between two states, one intended to impede the flow of traffic through it, and the other to allow traffic to flow through it. A series of sharp tines, or spears, placed at intervals across the roadway, is allowed to come into contact with the tires of a passing car when the apparatus is in the enabled (impeding) state. Should a car drive over the apparatus in this enabled state, the tines will penetrate the tires and damage them to the point where further driving of the vehicle will be difficult.

The apparatus can be placed in the safe (non-impeding) state by inserting a metal plate above the tines. The tires can then ride over the plate, without damage, thus allowing passage.

In order to accommodate surface mounting of the apparatus, two plates form a protective tent over the tines. The plates are connected at the apex with a hinge. The tines are placed under one of the plates (the front plate) on a base plate. The front plate is attached to the base plate through a second hinge. Thus the front plate is attached to the base plate with one hinge, and to the other (rear) plate that forms the protective tent with another hinge. A series of windows in the front plate is aligned with the tines, allowing the tines to show through the plate when the front plate is resting on the base. If the plate is allowed to rest on the base, or allowed to collapse under the weight of a car to rest on the base, the tines will be exposed and will damage a passing tire.

When the apparatus is placed in the safe state, a shutter-like plate comes between the front plate and the tines. In this state, the front plate cannot collapse to the ground, as it is supported by the shutter plate and by the tines. A car can then drive over the front plate which now acts as a ramp. Once the car has reached the apex of the protective tent, the tire continues down the rear plate, rolling down to ground. An arrangement of springs keeps the two plates above the tines, preventing the plates from collapsing from their own weight, or even from the weight of a pedestrian that may step on the protective plates.

The shutter that controls the two states of the apparatus can be driven by a small electric motor. Together with a suitable battery and electronic package, the apparatus becomes a self-contained wireless remote controlled access control point. Alternatively, the motor can be powered and controlled through an external electrical cable attached to external switches or a controller.

Broadly speaking, the invention is a vehicle, e.g., a car, access control device that has a plurality of vertically disposed tire piercing members or spears. An upwardly spring-biased tent-like covering over the spears protects pedestrians, the weight of a pedestrian being insufficient to force the covering from an upper position that covers the spears to a lower position where the spears are exposed, but the weight of a car being sufficient to do so. A control element in the form of a shutter or guard plate is movable by a remotely controlled actuator between a first position in which the spears are enabled to pierce the tires of a passing car (by allowing the weight of a passing vehicle to force the covering to move from its upper position to its lower position) and a second position in which the spears are disabled from piercing the tires of a passing car (by preventing the covering from lowering under the weight of a passing vehicle). The guard plate and the covering both have windows to allow the spears to pass therethrough when the guard plate is in the first position, the guard plate blocking the windows in the covering when the guard plate is in its second position.

A remotely-controlled battery-operated actuator mechanism moves the guard plate between its two positions, and the actuator can be locked in two positions corresponding to the first and second positions of the guard plate. The actuator operates to change the position of the guard plate to the position represented by the most recent remote control command, but it also determines whether the current position of the guard plate is that represented by the most recent remote control command and, if it is not, causes the position of the guard plate to be switched without the need for another remote control command.

The entire device sits on a base on which the spears are permanently and immovably mounted, all other elements of the device also being mounted on the base and the base being surface-mountable on a roadway without the need for digging into the roadway. An associated barrier indicates to a driver whether it is safe to go over the device, the actuator directly controlling the barrier to be raised or lowered in accordance with the current position of the guard plate determined by the actuator. The device has a width that is sufficient to pierce the tires on just one side of a car, the device having an overall configuration that allows two such devices to be placed in line to pierce the tires on both sides of a car.

BRIEF DESCRIPTION OF THE DRAWINGS

For a more complete understanding of the invention, reference is made to the following description, when taken in connection with the drawings, in which.

DETAILED DESCRIPTION OF THE PREFERRED EMBODIMENT

Tines Assembly

Figure 1:
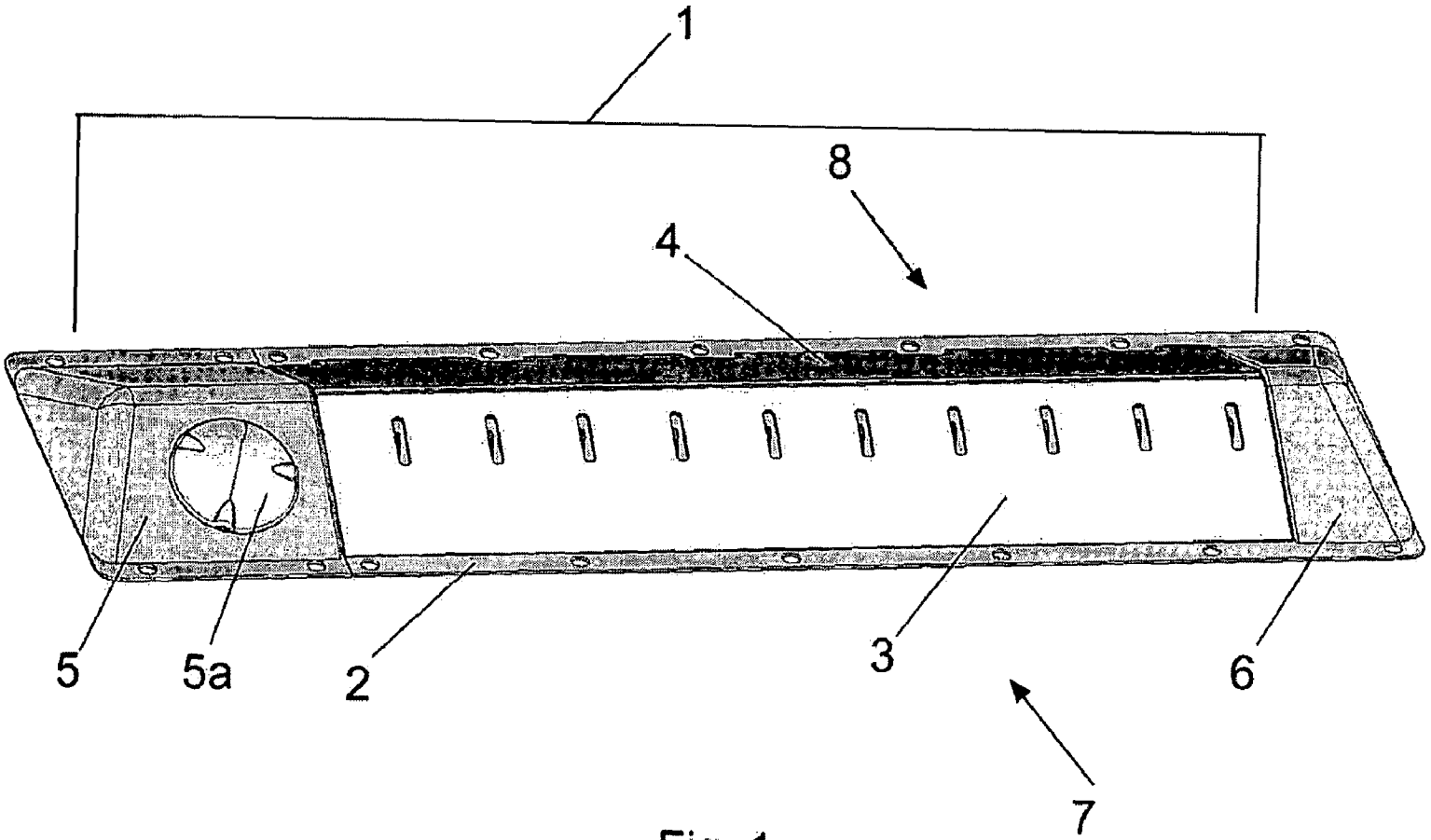
FIG. 1 is a perspective view of the tire deflator apparatus according to our invention.

With reference to FIG. 1, the apparatus 1 comprises a base 2, a front plate 3, a rear plate 4, a motor housing 5 and an end-cap 6. Within the metal motor housing 5 a plastic cover 5*a* provides a path for radio signals to the radio receiver inside the housing. While the apparatus is equally effective in controlling vehicular traffic moving in either direction 7 or direction 8, the description herein will refer to direction 7 as the "entry" direction, and direction 8 as the "exit" direction.

Figure 2:
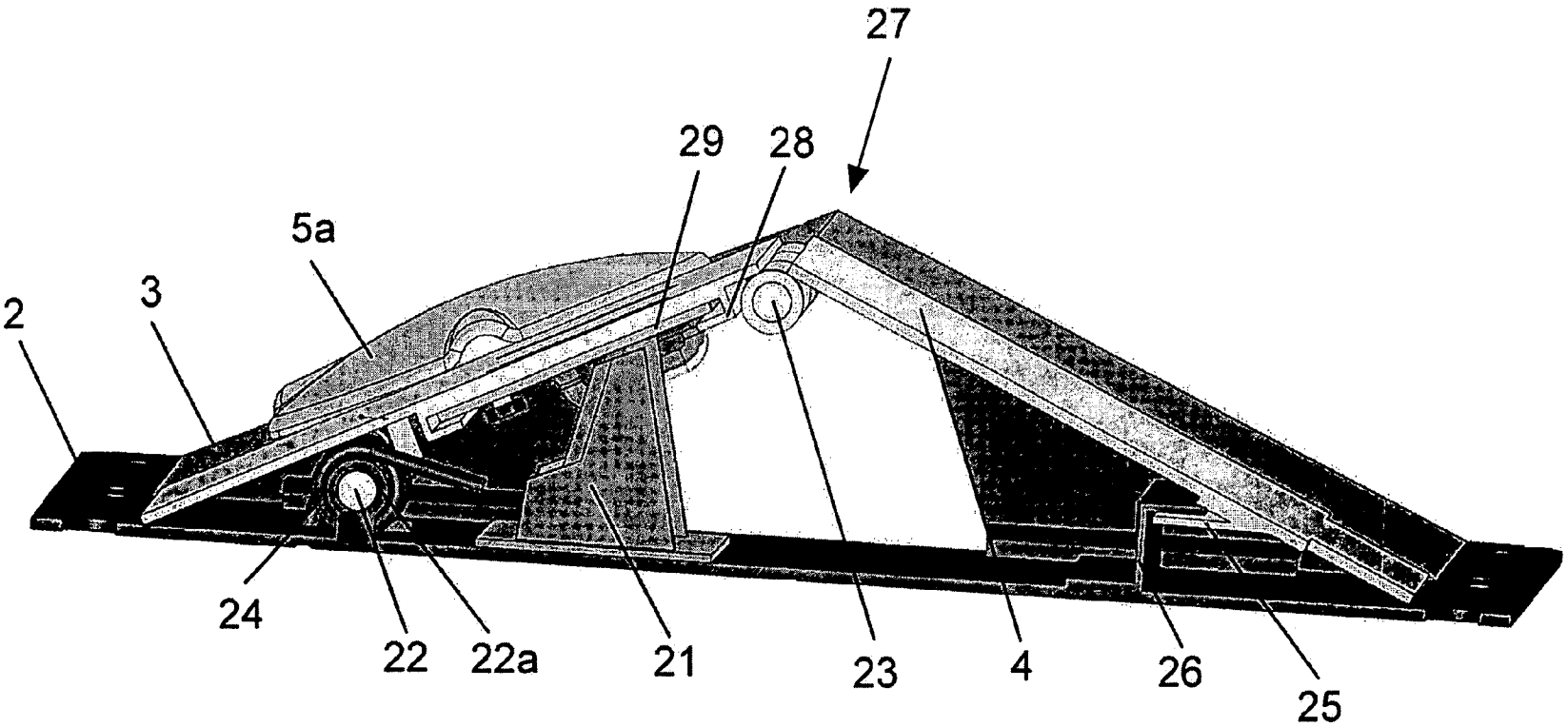
FIG. 2 is a perspective cutout view of the deflator tines and the components surrounding them, shown with the apparatus in the safe state.

With reference to FIG. 2, each stationary tine or spear 21 is permanently and fixedly mounted on base 2. Alternatively, however, the tines may be installed so that they can slide laterally on the base. Plate 3 is attached to base 2 through hinge 22. Plate 4 is attached to plate 3 through hinge 23, and rests on base 2 at its other end. A series of springs 24 are interspersed between the hinge sections 22*a*. The springs 24 exert a force on plate 3 that offsets the weight of the plates 3 and 4, and keep these plates up. The upward movement of plate 3 causes the bottom end of plate 4 to slide toward the center of the device (toward the tines), until stopped by bracket 25 engaging bracket 26. Bracket 25 is an integral part of plate 4, while bracket 26 is an integral part of base 2. The force exerted by springs 24 on plate 3 can be overcome by a force 27 applied vertically to the apex of the tent created by plates 3 and 4. In the preferred embodiment of our invention, the minimum value of force 27 required to collapse the tent formed by the plates is greater than the weight of an adult who can be expected to step on the plates. This allows pedestrians to step on the tent without causing the plates to move, thus keeping pedestrians safe from tines 21 that are beneath the tent.

Figure 3:
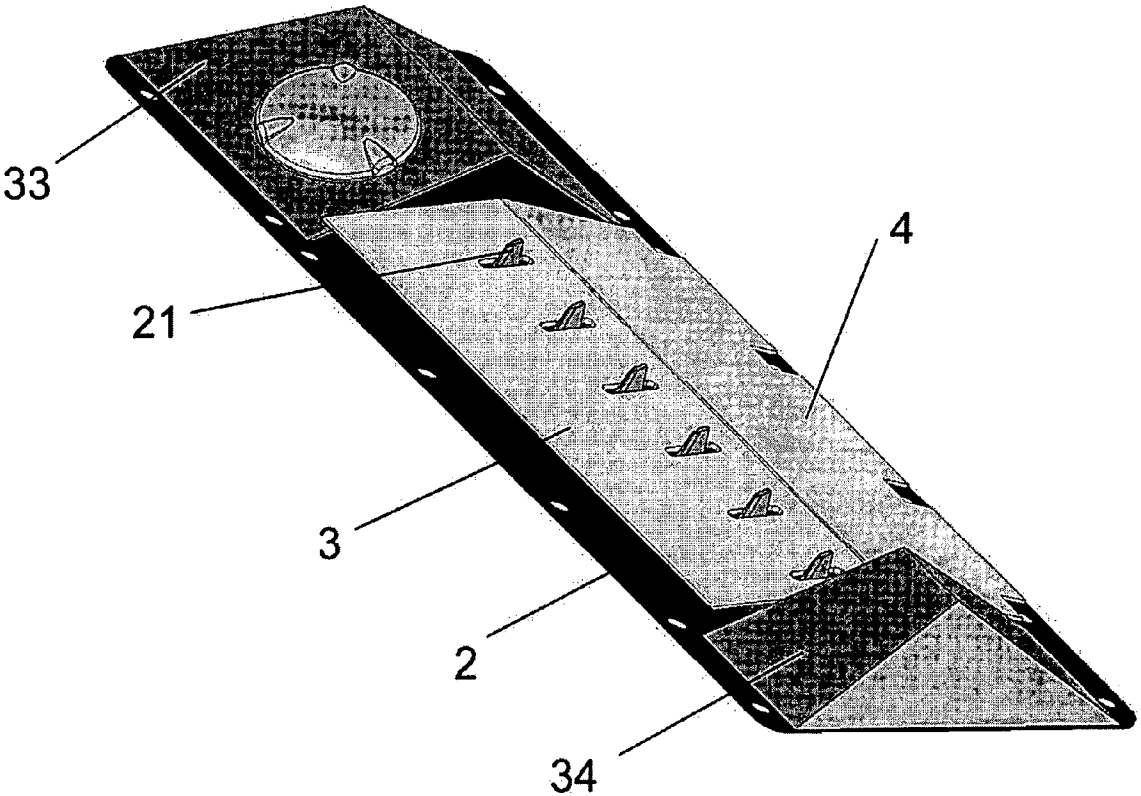
FIG. 3 is a perspective view of the apparatus in the enabled state, with the protective plate depressed.
Figure 4A:
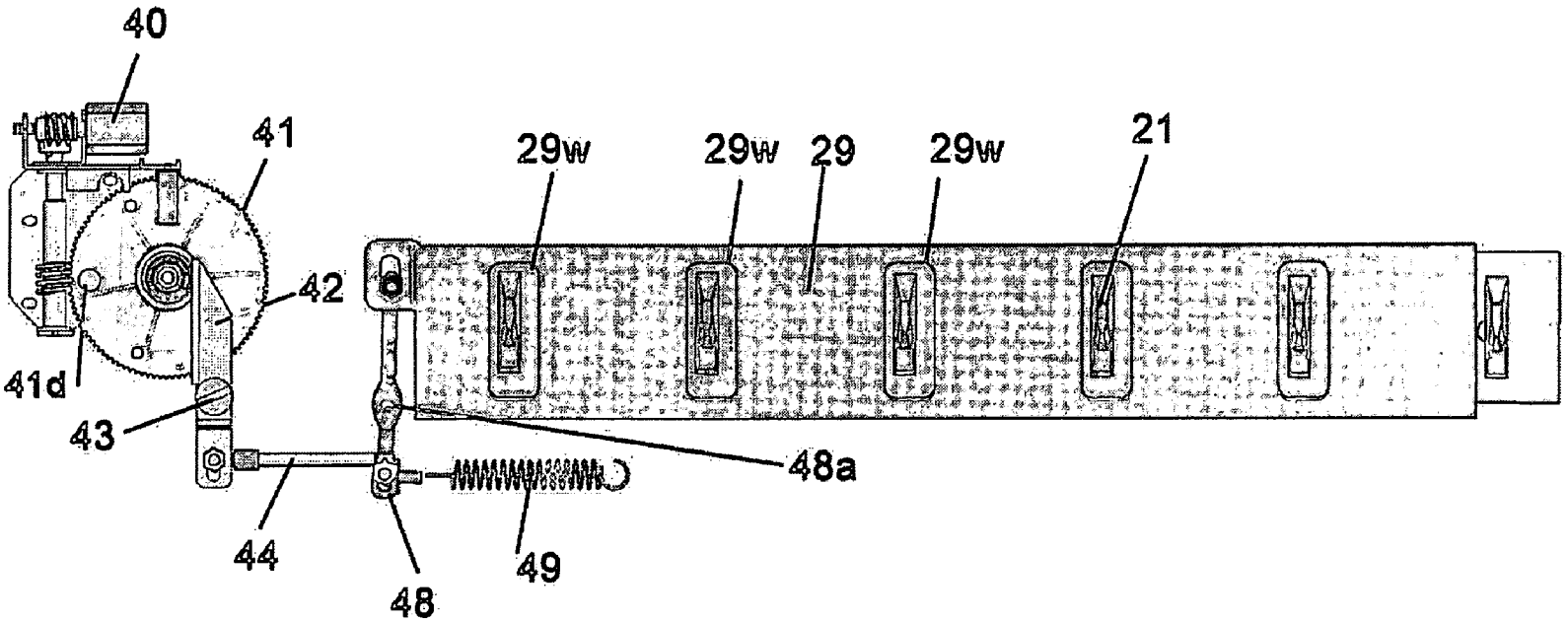
FIG. 4*a* is a view of the motor assembly that controls the shutter, with the shutter in the enabled state.

Plate 3 incorporates a slide channel 28 and a shutter or guard plate 29. The plate, the slide channel and the shutter are all provided with windows which align with the tines (FIG. 4*a*). This allows plate 3 to rotate on hinge 22 and move past the tines until it lies flat on the base plate 2, as indicated in FIG. 3. In this figure, the apparatus is shown with its protective plates 3 and 4 collapsed to expose the tines 21. The two ends of the apparatus are motor housing 33 and end-housing 34. These are stationary at all times.

Shutter 29 can slide laterally in channel 28, until its windows 29*w* (FIG. 3) no longer align with the tines. In that case, the solid sections on the shutter, between the windows, will be positioned directly above the tines. If force is applied in direction 27, overcoming the counter force created by springs 24, plate 3 will start to move in the direction 27. However, once shutter 29 comes in contact with the tines, no further downward motion will be possible. Tines 21 are shaped so that the shutter comes in contact with as large an area of the tines as possible, to prevent the tines from being damaged by the force exerted on them when a car drives over the plate 3 in the safe mode.

The shutter or guard plate 29 thus moves in two directions. Movement in the horizontal direction (parallel to the ground) determines whether the windows are aligned with the tines such that the overall device is in its enabled state in which the tines become operative should a car move over them. Movement of the guard plate in the vertical direction (along with plate 3 that carries it) takes place when the device is in its enabled state and a car passes over it.

Motor Assembly

The motor assembly controls the alignment of the tines 21 and the windows 29*w*. When the windows are aligned with the tines, the apparatus is enabled (a car's weight will close the tent and expose the tines); when the windows are offset from the tines, the apparatus is safe (the shutter prevents plate 3 from folding around the tines).

With reference to FIG. 4*a*, motor 40 drives gear wheel 41 through intermediary gears, in order to reduce the speed of gear 41 and increase its available torque. Arm 42 is held against the center of gear 41 by spring 49 acting through linkage 44. Shutter 29 is in its leftmost position. In this position the windows 29*w* in the shutter align with the tines 21 and the deflator is in the enabled state. (The tines 21 can be seen through the windows 29*w* in FIG. 4*a*.)

Figure 4B:
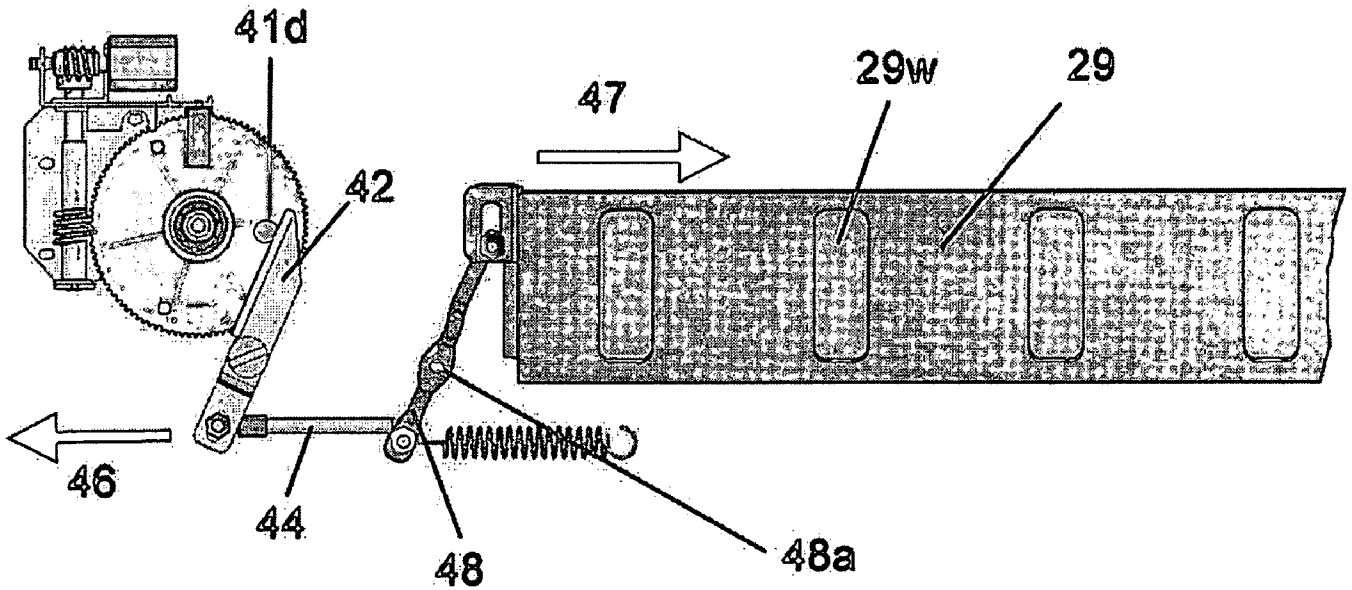
FIG. 4*b* is a view of the motor assembly that controls the shutter, with the shutter in the safe state.

With reference to FIG. 4*b*, motor 40 rotates gear wheel 41 counter-clockwise until cam 41*d* on the gear wheel pushes arm 42 to the right. Linkage 44 travels in direction 46, pulling arm 48 with it. Arm 48 swivels on pin 48*a*, forcing the shutter 29 to move in direction 47. As shown in FIG. 4*b*, the windows 29*w* in the shutter are no longer aligned with the tines, and the apparatus is in the safe mode. (The tines 21 can no longer be seen through the windows 29*w* in FIG. 4*b*.)

Figure 4C:
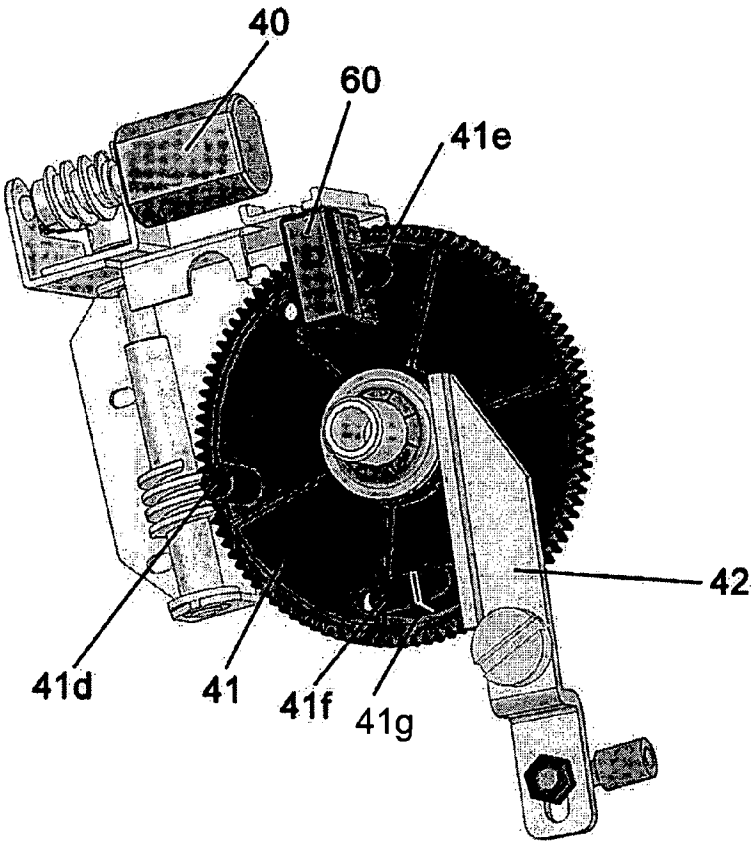
FIG. 4*c* is a view of the gear wheel detail and the sensor that controls operation of the motor.

With reference to FIG. 4*c*, gear 41 is provided with tabs 41*e* and 41*f*. These tabs (which pass under arm 42 and, unlike cam 41*d*, do not engage the arm) are used to block optical sensor 60 when the gear has reached either of its stop positions. The sensor 60 is of the transmissive type; it is shaped like a "U", with an IR transmitting diode in one leg of the U, and a receiving IR diode in the opposite leg. As the tabs 41*e* or 41*f* rotate, they come in between the sensor's IR diodes and thus can block them. When a tab blocks the sensor, the output of the sensor is high. When there is no blockage of the sensor, the output of the sensor is low. A transition from low to high occurs when a tab just moves in to block the sensor.

The safe position is when cam 41*d* is in contact with arm 42 (FIG. 4*b*). The enabled position is 180 degrees of rotation away (FIGS. 4*a* and 4*c*). Motor 40 is powered through an electronic module. This module is a combination radio receiver and motor controller. The radio receiver decodes radio commands from one or more remote transmitters and operates the motor so that it rotates 180 degrees after each accepted command. Thus the apparatus will toggle between its two states with each accepted radio command.

When a valid toggle command is decoded by the radio, motor 40 is started. Power to the motor stays on until the leading edge of tab 41*e* or tab 41*f* blocks the sensor 60. Once the sensor is blocked by either of the tabs, the motor stops and the new state is maintained until the next toggle command. When a new command is received, the motor is started and allowed to run until the opto-sensor reports to the electronic module that a transition from unblocked to blocked has occurred.

Figure 5:
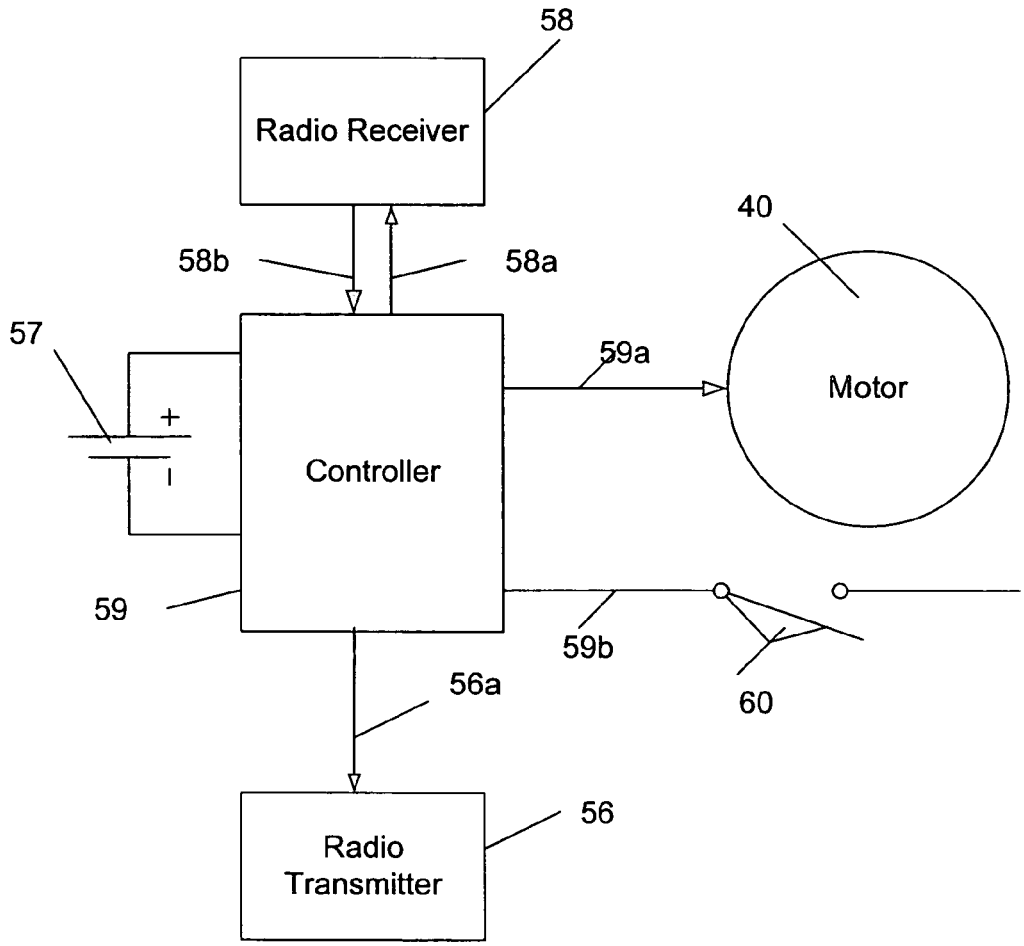
FIG. 5 is a block diagram of the electronic module that controls the motor operation.

An alternative mode of control requires that the apparatus respond discretely to either of two different commands, an 'enable' command and a 'safe' command. In order to achieve this requirement, the controller needs to know at any point whether gear 41 is stopped in the enable position or in the safe position. In the preferred embodiment of our invention, this is achieved through the use of a slot 41*g* in tab 41*f*. FIG. 5 is a block diagram of the control circuit of the invention. The controller is powered by battery 57. In our preferred embodiment, the battery is comprised of four alkaline D cells that can power the system for well over one year under normal use. The controller supplies power to the radio receiver. When a valid RF signal is received by radio receiver 58, it sends a signal over conductor 58*a* to the controller 59. The controller 59 activates the motor through line 59*a*. The sensor 60 reports over line 59*b* when the motor gear reaches a predefined position. Transmitter 56 is powered by the controller through line 56*a*. The transmitter is used to provide feedback to external devices (not shown) on the status of the deflator apparatus.

Figure 6:
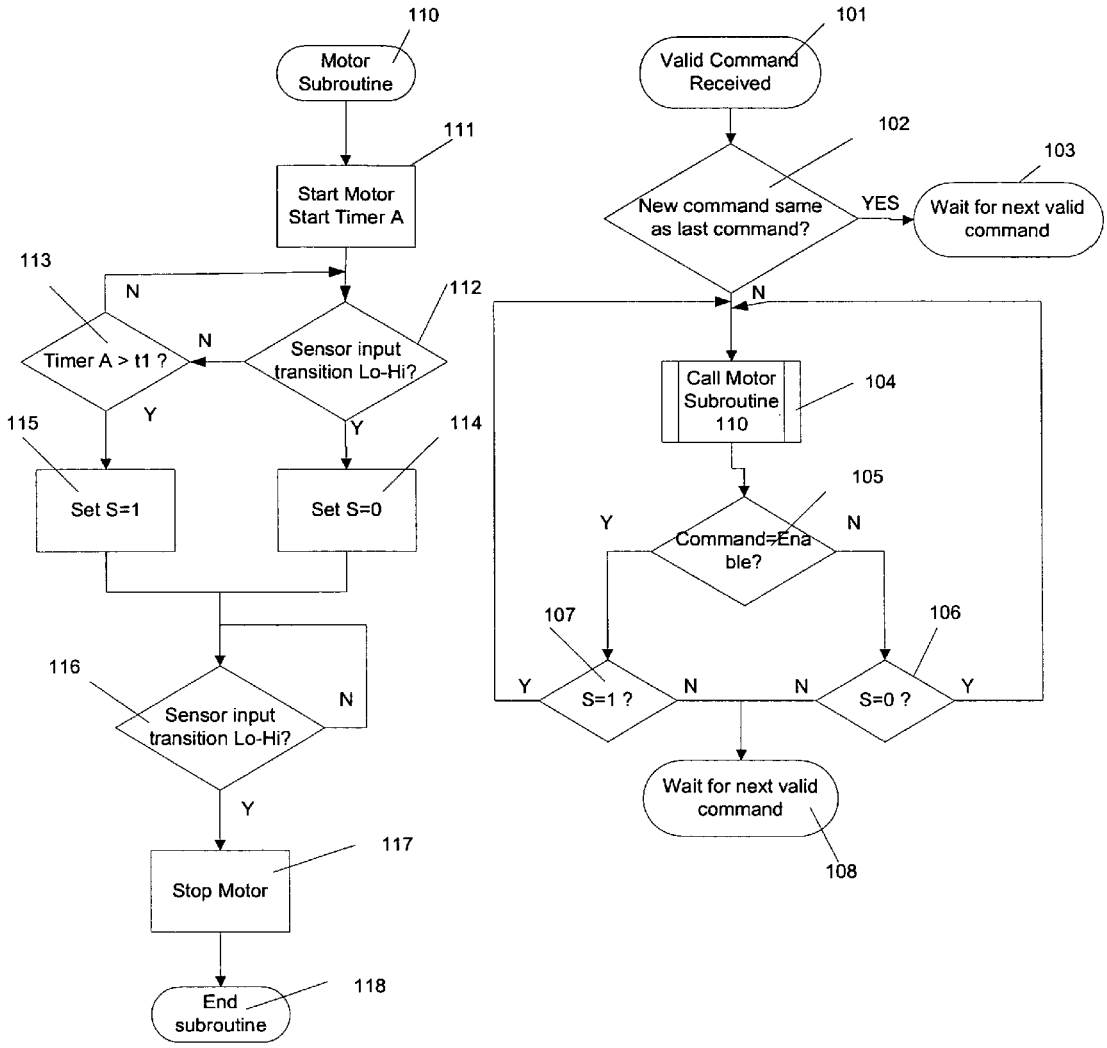
FIG. 6 is a flow chart of the logic that controls the motor operation.

FIG. 6 is a flow chart showing the logic implemented in the controller software to achieve the discrete control commands for enabling and disabling the apparatus.

With reference to FIG. 6, when a radio command is received and decoded, the motor actuation logic starts at point 101. If the command is the same as the previous command, it is ignored and the routine terminates at 103. If the new command received is different from the previous command, then in step 104 a subroutine 110 is called. This subroutine starts the motor and starts a timer A (111). The logic then waits for a transition from low to high on the opto-sensor 60 (112), which transition occurs when either tab 41*f* or tab 41*e* enters the opto-sensor and blocks the sensor's optical beam, or when tab 41*f* is in the opto-sensor and moves slightly until the trailing edge of slot 41*g* in tab 41*f* reaches the optical beam in the sensor. (When the slot first reaches the optical beam the output of the sensor goes from high to low; at the trailing edge of the slot, when the beam is blocked once again, the output goes from low to high.) A test is performed to determine if the low-to-high transition occurs before timer A reaches a preset time $t_1$; the time $t_1$ is much shorter than the time it takes for gear 41 to travel 180 degrees. If a transition occurs before the timer times out, it means that tab 41*f* with its slot is within the sensor and the gear 41 has just left the safe state (FIG. 4*b*) and is rotating toward the enabled state (FIGS. 4*a* and 4*c*). The logic proceeds to step 114, where a variable S is set to 0; this indicates that the device will soon be in the enabled state. If the timer A times out (113) before a transition is detected in step 112, the logic reaches step 115 where the variable S is set to 1 to indicate that the device will soon be in the safe state.

In either case, after step 114 or 115, the logic waits in step 116 for the sensor transition that indicates that the next tab on gear 41 has just reached the sensor. As soon as the low-to-high transition is detected, the logic proceeds to step 117 where the motor is stopped and the subroutine exits in step 118. Control is now returned to the main routine at step 105 (following the call to the motor subroutine). The logic now compares the received command with the actual position of the gear 41, as recorded in the S variable that is returned by subroutine 110. If the position of gear 41 matches the command, the mission has been successfully accomplished and the routine is terminated. If the command was "enable", the logic proceeds to step 107. If the variable returned was S=0, it means that the gear is now in the enabled position, allowing the routine to terminate in step 108. Likewise, if the command was "safe", the logic proceeds to step 106. If the motor subroutine returned a value of 1 for the variable S, it means that the gear achieved the desired position and the routine terminates in step 108.

If in step 107 or step 106 there is a mismatch between the command and the S value, the routine proceeds to step 104 which runs the motor subroutine again. This step automatically synchronizes the gear position with the received command, to correct potential errors that can be caused during power up or by other error sources.

The movement of the shutter 29 between the enabled state and the disabled (safe) state provides a visual indication to the entering driver as to the state of the apparatus. The shutter may be painted with a bright color, for example green, while the tines may be painted a bright red color. When the apparatus is in the enabled mode, the red tines show through the slots. When the apparatus is in the safe state, the green shutter shows through the windows in the front plate. Additional means of indicating the state of the apparatus may include a small flag, a large disc with two colors, and the like.

Operation With Wireless Barrier

As is common in the industry, deflators are used in conjunction with barriers to create a complete gate system. The barrier acts as a visual flag to prevent an unsuspecting driver from entering the premises, while the deflator intimidates a driver who may intentionally want to overrun the gate.

Our United States patent application 2004/0165949A1 describes a wireless and wire-free barrier that uses the weight of a vehicle as the motive energy to raise the barrier through a remote control command. By combining the wireless barrier and the wireless deflator, a complete wireless gate system can be assembled.

Figure 7:
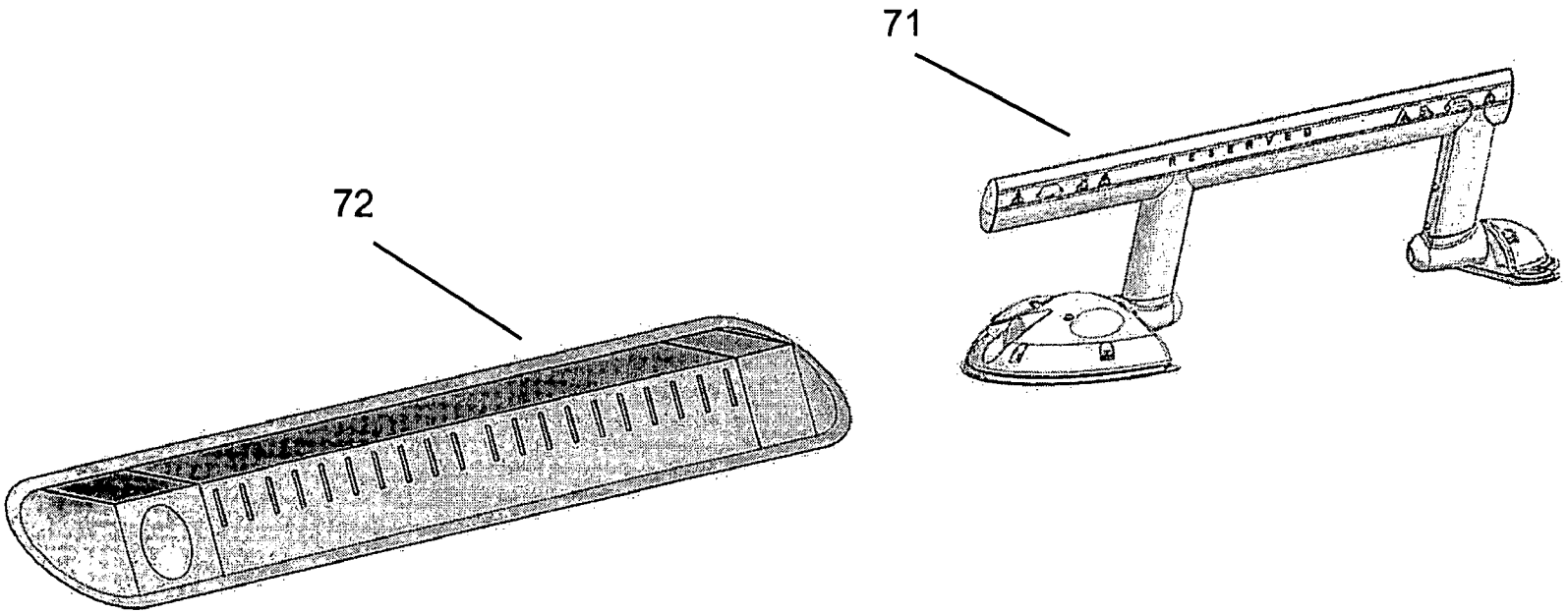
FIG. 7 is a perspective view of the apparatus installed in combination with a wire-free barrier.

FIG. 7 shows a barrier 71 and a deflator 72 placed side by side to block vehicular access. In operation, the deflator is programmed to respond to a remote controller and the barrier is programmed to respond to radio commands from the deflator. When the deflator receives a valid command to toggle the gate, it proceeds with the execution as depicted in FIG. 6. Once it has completed the execution (e.g., when entering step 108), the deflator can send a coded transmission to the barrier, instructing it to toggle. An advantage of having the tire deflator control the barrier is that since the barrier acts as a flag, indicating to the entering or exiting driver whether it is safe to do so, the barrier cannot misinform the public about the state of the deflator since the deflator directly controls the barrier to be raised or lowered in accordance with its current state.

An alternative way is to provide a wired connection between the two devices, where the deflator directly controls the barrier. If the barrier is powered, then a similar connection can also be used to bring in outside power for the deflator.

It is expected that deflators will be manufactured in sections, for example, 36 inches wide. In narrow access points, it will be sufficient to use just one such deflator. For wider access points, two or more sections can be installed in line, and through a simple linkage operated together.

Although the invention has been described with reference to a particular embodiment, it is to be understood that this embodiment is merely illustrative of the application of the principles of the invention. Numerous modifications may be made therein and other arrangements may devised without departing from the spirit and scope of the invention.

The invention claimed is:

1. A vehicle access control device comprising a plurality of vertically disposed tire piercing members; a control element movable in a first direction between a first position in which said tire piercing members are enabled to pierce the tires of a passing vehicle and a second position in which said tire piercing members are disabled from piercing the tires of a passing vehicle, and movable in a second direction under the weight of a passing vehicle to allow said tire piercing members to pierce the tires of said passing vehicle; and a remotely controlled actuator for moving said control element in said first direction between said first and second positions.

2. A vehicle access control device in accordance with claim 1 wherein said tire piercing members are stationary and further including a covering over said tire piercing members that protects pedestrians from said members, said covering being movable between a lower position in which said members are exposed and an upper position in which said members are covered, and said control element is a guard plate that is movable in said first direction relative to said covering so that when said guard plate is in its first position it allows the weight of a passing vehicle to force said covering to move from its upper position to its lower position and when said guard plate is in its second position it prevents the weight of a passing vehicle from forcing said covering to move from its upper position to its lower position.

3. A vehicle access control device in accordance with claim 2 in which said guard plate is moved horizontally, and said guard plate and said covering both have windows to allow said tire piercing members to pass therethrough when said guard plate is in said first position, said guard plate blocking the windows in said covering when said guard plate is in its second position.

4. A vehicle access control device in accordance with claim 3 wherein said remotely controlled actuator is battery-operated.

5. A vehicle access control device in accordance with claim 3 wherein said remotely controlled actuator can be locked in two positions corresponding to said first and second positions of said guard plate, and wherein said actuator operates to change the position of said guard plate to the position represented by the most recent remote control command.

6. A vehicle access control device in accordance with claim 5 further including a mechanism that determines whether the current position of said guard plate is that represented by the most recent remote control command and, if it is not, causes the position of said guard plate to be switched without the need for another remote control command.

7. A vehicle access control device in accordance with claim 3 further including a base on which said tire piercing members are permanently and immovably mounted, all other elements of the device also being mounted on said base and said base being surface-mountable on a roadway without the need for digging into the roadway.

8. A vehicle access control device in accordance with claim 3 further including an associated barrier that indicates to a driver whether it is safe to go over the tire piercing members, the actuator directly controlling the barrier to be raised or lowered in accordance with the current position of the guard plate determined by the actuator.

9. A vehicle access control device in accordance with claim 3 wherein the device has a width that is sufficient to pierce the tires on just one side of a car, the device having an overall configuration that allows two such devices to be placed in line to pierce the tires on both sides of a car.

10. A vehicle access control device in accordance with claim 2 wherein said remotely controlled actuator is battery-operated.

11. A vehicle access control device in accordance with claim 2 wherein said remotely controlled actuator can be locked in two positions corresponding to said first and second positions of said guard plate, and wherein said actuator operates to change the position of said guard plate to the position represented by the most recent remote control command.

12. A vehicle access control device in accordance with claim 11 further including a mechanism that determines whether the current position of said guard plate is that represented by the most recent remote control command and, if it is not, causes the position of said guard plate to be switched without the need for another remote control command.

13. A vehicle access control device in accordance with claim 2 further including a base on which said tire piercing members are permanently and immovably mounted, all other elements of the device also being mounted on said base and said base being surface-mountable on a roadway without the need for digging into the roadway.

14. A vehicle access control device in accordance with claim 1 further including an associated barrier that indicates to a driver whether it is safe to go over the tire piercing members, the actuator directly controlling the barrier to be raised or lowered in accordance with the current position of the control element determined by the actuator.

15. A vehicle access control device in accordance with claim 1 wherein the device has a width that is sufficient to pierce the tires on just one side of a car, the device having an overall configuration that allows two such devices to be placed in line to pierce the tires on both sides of a car.

16. A car access control device comprising a plurality of vertically disposed tire piercing members, a covering over said tire piercing members that protects pedestrians from said members, said covering being movable between a lower position in which said members are exposed and an upper position in which said members are covered, the weight of a pedestrian being insufficient to force said covering from said upper position to said lower position but the weight of a car being sufficient to do so, and a mechanism for selectively enabling and disabling said covering to move under the weight of a car from said upper position to said lower position.

17. A car access control device in accordance with claim 16 wherein said covering is tent-like and further including springs that bias the covering to said upper position, said mechanism including a plate that is movable relative to said covering so that when said plate is in a first position it allows the weight of a passing vehicle to force said covering to move from its upper position to its lower position and when said plate is in a second position it prevents the weight of a passing vehicle from forcing said covering to move from its upper position to its lower position.

18. A car access control device in accordance with claim 17 wherein said plate is moved horizontally, and said plate and said covering both have windows to allow said tire piercing members to pass therethrough when said plate is in said first position, said plate blocking the windows in said covering when said plate is in its second position.

19. A car access control device in accordance with claim 17 wherein said mechanism is battery-operated.

20. A car access control device in accordance with claim 17 wherein said mechanism can be locked in two positions corresponding to said first and second positions of said plate, and wherein said mechanism operates to change the position of said plate to the position represented by a most recent remote control command.

21. A car access control device in accordance with claim 20 wherein said mechanism determines whether the current position of said plate is that represented by the most recent remote control command and, if it is not, causes the position of said plate to be switched without the need for another remote control command.

22. A car access control device in accordance with claim 17 further including a base on which said tire piercing members are permanently and immovably mounted, all other elements of the device also being mounted on said base and said base being surface-mountable on a roadway without the need for digging into the roadway.

23. A car access control device in accordance with claim 17 further including an associated barrier that indicates to a driver whether it is safe to go over the tire piercing members, said mechanism directly controlling the barrier to be raised or lowered in accordance with the current position of the plate determined by the mechanism.

24. A car access control device in accordance with claim 23 wherein the device has a width that is sufficient to pierce the tires on just one side of a car, the device having an overall configuration that allows two such devices to be placed in line to pierce the tires on both sides of a car.

25. A car access control device in accordance with claim 16 wherein said mechanism is battery-operated.

26. A car access control device in accordance with claim 16 wherein said mechanism can be locked in two positions corresponding to said first and second positions of said plate, and wherein said mechanism operates to change the position of said plate to the position represented by a most recent remote control command.

27. A car access control device in accordance with claim 26 wherein said mechanism determines whether the current position of said plate is that represented by the most recent remote control command and, if it is not, causes the position of said plate to be switched without the need for another remote control command.

28. A car access control device in accordance with claim 16 further including a base on which said tire piercing members are permanently and immovably mounted, all other elements of the device also being mounted on said base and said base being surface-mountable on a roadway without the need for digging into the roadway.

29. A car access control device in accordance with claim 16 further including an associated barrier that indicates to a driver whether it is safe to go over the tire piercing members, said mechanism directly controlling the barrier to be raised or lowered in accordance with the current position of the plate determined by the mechanism.

30. A car access control device in accordance with claim 16 wherein the device has a width that is sufficient to pierce the tires on just one side of a car, the device having an overall configuration that allows two such devices to be placed in line to pierce the tires on both sides of a car.

* * * * *